US008098854B2

(12) United States Patent
van Halteren et al.

(10) Patent No.: US 8,098,854 B2
(45) Date of Patent: Jan. 17, 2012

(54) MULTIPLE RECEIVERS WITH A COMMON SPOUT

(75) Inventors: Aart Zeger van Halteren, Hobrede (NL); Onno Geschiere, Amsterdam (NL)

(73) Assignee: Sonion Nederland BV, Amsterdam (NL)

( * ) Notice: Subject to any disclaimer, the term of this patent is extended or adjusted under 35 U.S.C. 154(b) by 1176 days.

(21) Appl. No.: 11/846,368

(22) Filed: Aug. 28, 2007

(65) Prior Publication Data

US 2008/0063223 A1 Mar. 13, 2008

Related U.S. Application Data

(60) Provisional application No. 60/840,585, filed on Aug. 28, 2006.

(51) Int. Cl.
*H04R 25/00* (2006.01)

(52) U.S. Cl. ..... 381/182; 381/418; 381/417; 381/322; 381/324; 381/351; 381/312; 381/342

(58) Field of Classification Search ..... 381/182, 381/418, 417, 322, 324, 351, 312, 342
See application file for complete search history.

(56) References Cited

U.S. PATENT DOCUMENTS

| | | | | |
|---|---|---|---|---|
| 5,692,059 | A * | 11/1997 | Kruger | 381/151 |
| 2003/0190053 | A1 * | 10/2003 | van Halteren | 381/418 |
| 2006/0133636 | A1 | 6/2006 | Harvey et al. | 381/380 |

* cited by examiner

*Primary Examiner* — Tom Thomas
*Assistant Examiner* — Benjamin Tzu-Hung Liu
(74) *Attorney, Agent, or Firm* — Nixon Peabody LLP

(57) ABSTRACT

A speaker module for a personal communication device includes two transducers for generating sound on the basis of an electrical signal. One transducer outputs sound to the surroundings from a sound output thereof and the other transducer outputs sound to the surroundings via the first transducer. In this manner, two transducers require only one sound output. The sound from the second transducer may be transmitted through and filtered by an opening in a diaphragm of the first transducer. Filtering elements may be provided between the two transducers.

20 Claims, 4 Drawing Sheets

MULTIPLE RECEIVERS WITH A COMMON SPOUT

CROSS-REFERENCE TO RELATED APPLICATION

This application claims the benefit of the U.S. Provisional Application 60/840,585, filed on Aug. 28, 2006, entitled "Multiple Receivers With A Common Spout" and is hereby incorporated by reference in its entirety.

FIELD OF THE INVENTION

The present invention relates to a system comprising two transducers/receivers for outputting sound from a single output, and in particular to a system where one transducer outputs sound via the other transducer.

BACKGROUND OF THE INVENTION

In today's In Ear Monitors (IEMs) and similar devices for Personal Use (Personal Monitors), very often more than one receiver is used to obtain the required performance in terms of frequency range extension and maximum sound pressure capability. One example of such a multiple receiver or speaker IEMs is disclosed in US Published Patent Application 2006/0133636, titled "Sound Tube Tuned Multi-Driver Earpiece." In such receivers/speakers, it is required to connect the separate sound outlets or spouts of each receiver to respective appropriately dimensioned sound tubes or sound conducting members in an acoustically sealed manner. The 3300 series receiver manufactured and sold by Sonion Nederland B.V comprises two back-to-back mounted moving armature receivers with separate sound ports emitting respective sound signals into a common spout. Both of these solutions put requirements to the space required by and the acoustical properties of this acoustical coupling.

SUMMARY OF THE INVENTION

One object of this invention is to provide a speaker module or assembly that simplifies the mounting and sealing of a multiple receiver output. A significant advantage of the present loudspeaker module is the potential reduction of the space occupied by the sound tubes and/or sound conducting members, which is particularly important in hearing prostheses and IEMs that must fit inside the ear canal or outer ear of the user.

In a first aspect, the invention relates to a speaker module for use in a personal communication device, the module comprising a first transducer and a second transducer. The first transducer is adapted to receive a first electrical signal and output a corresponding sound and comprises a first housing, a movable diaphragm positioned inside the first housing and which divides an inner space of the first housing into a first chamber and a second chamber, a sound output port connecting one or both of the first chamber and the second chamber to the surroundings, and a sound input connected to the first or the second chamber. The second transducer is adapted to receive a second electrical signal and output a corresponding sound and comprises a second housing, a movable diaphragm positioned within the second housing and which divides an inner space of the second housing into a third chamber and a fourth chamber, and a sound output connected to one or both of the third chamber and the fourth chamber, the second sound output being acoustically connected to the sound input of the first transducer.

In the present context, a personal communication device is a device which may be portable and battery operated and which is used for providing sound for the person. Such a device may be a headset, a hearing aid, an in-ear monitor, a hearing protection device, a cell-phone, a PDA, or the like.

Sound or audible sound normally is defined as having a frequency of between 20 Hz and 20 kHz, even though wider or narrower intervals may be used in certain situations.

Preferably, in the first housing, the sound inlet is positioned at a first location and the sound outlet in a different location so that the sound output of the second transducer propagates from the second housing to the surroundings via the first and/or second chambers of the first housing. Then, when both transducers/receivers are active, the output of the assembly is the sum of the output of the first receiver/transducer and that of the second receiver/transducer as affected by the transport through the first receiver/transducer.

The present speaker module need not be assembled to a single module. The individual transducers may initially be separate to be fixed to each other at a later point in time, or they may be acoustically assembled (in order to have the sound output of the second transducer acoustically connected to the sound input of the first transducer) in a manner where these transducers are not fixed to each other or a common member.

In fact, as will also be described further below, an element may be provided for guiding sound from the sound output of the second transducer to the sound input of the first transducer, so that these transducers need not abut or be fixed in relation to each other.

In this context, the housings each define an inner space in which the diaphragm is positioned. In order for the diaphragm to provide a suitable sound pressure, the diaphragm should divide the inner space into two chambers, normally called the front and back chamber, where the sound output may be from any of these chambers. Smaller venting openings may be provided in the housing and/or diaphragm in order to provide static pressure relief. In addition vent opening(s) in the housing may be used to increase the volume of one or more chambers of the first and second transducers to, for example, increase the low frequency output level. In some instances, the vent openings may advantageously be utilized to form a Helmholtz resonator with a resonance frequency between, for example, 60 Hz and 200 Hz. In fact, two or more vents may be acoustically connected to any chamber in order to adapt or tailor the frequency response of the transducer in question to any desired shape. Thus, when providing a tuned venting or any other opening from a chamber to the surroundings, no additional opening is required to handle the static pressure relief.

The present "connecting" of the input or output to the surroundings will be an acoustic connection where sound is propagated between the chamber in question and the surroundings. It is noted that this connection may be obtained via a flexible element or via an opening. In addition to providing a sound or acoustical connection, this element or opening may also provide a frequency dependent filtering of the sound. This is usual and is taken into account when defining the transducer and its sound output characteristics.

In the present context, the transducers receive an electrical signal and provide a corresponding sound. Naturally, many forms of correspondence may be seen in that even in macroscopic loudspeakers, different loudspeakers have different sounds when playing the same music. This is accepted, and the sound desired or required is a matter of personal taste or of the requirements of the listener. Thus, the sound output of a hearing aid in the ear of a hearing impaired person may be strongly filtered to emphasize certain frequency intervals, but this is required in order to have the person hear the sound in a more natural or neutral manner due to the person's hearing impairedness. This desired sound may be generated by altering the electrical signal and/or the acoustical elements or characteristics of the transducer. Either way, this will also be seen as a sound corresponding to the electrical signal.

Naturally, any type of electro-acoustical transducer may be used in loudspeaker modules according to the present invention, such as, but not limited to, Balanced Armature Receivers, Moving Coil receivers, piezoelectric receivers, etcetera, or any combination thereof.

The second transducer preferably has no other sound outputs, and outputs its sound via the sound inlet and first/second chamber(s) of the first transducer.

Clearly, in addition to the limitation of the number of sound output ports to the surroundings, the invention also provides numerous additional manners of filtering the sound from the second transducer. Naturally, both the acoustical properties of the sound inlet of the first transducer as well as the acoustical properties of the first transducer will affect the sound received from the second transducer before outputting this sound.

In one embodiment, the sound output port of the first transducer is connected to the first chamber, and the sound input of the first transducer is connected to the second chamber. Thus, in this embodiment, sound from the second transducer is transmitted to the surroundings via also the diaphragm of the first transducer.

In that embodiment, the diaphragm of the first transducer or the diaphragm suspension may comprise a hole or opening of predetermined shape and dimensions. This opening will then also affect the sound of the second transducer, since sound is propagated through the hole or opening in order to exit the first transducer. This opening may have dimensions sufficiently large to provide a frequency selective filtering of the sound passing through the diaphragm. The larger the opening or hole is, the lower will be the attenuation of especially higher frequencies when passing this opening/hole.

In general, the first transducer may have a first acoustic resonance frequency and the second transducer may have a second acoustic resonance frequency, the second resonance frequency being lower than the first resonance frequency, where the opening or hole in the diaphragm of the first transducer then is adapted to transmit sound at the second resonance frequency.

In this situation, the resonance frequency is that of moving parts in the transducer, normally the diaphragm and movable parts of the driving means driving the diaphragm. Normally, the higher the resonance frequency, the higher a sound frequency spectrum is the transducer used for emitting or radiating. Thus, a tweeter normally has a higher resonance frequency than a mid-range transducer or a woofer. Naturally, the two transducers may have substantially the same resonance frequency. Then, if the transducers have different impedances, the lower impedance transducer may be used as a tweeter, by coupling through a capacitor, and the other transducer may be used as a woofer.

Of course, the transducers may have different sizes. Normally, the larger housing will have the lower acoustical resonance frequency.

Naturally, the frequency response of a transducer need not be fully defined by the resonance frequency. A tweeter having a resonance frequency of 2-5 kHz normally will be able to output up to 20 kHz, and a woofer having a resonance frequency as low as possible (e.g. about 500-1500 Hz) may output sound below 20-50 Hz.

Then, the opening in the diaphragm/suspension will be able to transmit the sound to at least a significant degree. In this context, "transmit" will mean attenuate at most about 1 dB or 3 dB. For example, an opening of 50-300 μm will transmit frequencies of up to about 40 Hz with virtually no attenuation. Sound at 500 Hz, for example, may, in contrast, be attenuated more than 20 dB.

Thus, the second transducer may be used as a woofer transmitting the lower frequencies of the overall sound into the first transducer, through the opening/hole in the diaphragm/suspension and out via the output port of the first transducer, which then may be used as a tweeter.

In another embodiment, the module comprises a sound filtering means adapted to guide sound from the sound output of the second transducer to the sound input of the first transducer, the sound filtering means having dimensions providing a filtering of the guided sound. The sound filtering means may be used for attaching the first and second transducers to each other or fixing them in relation to each other. The sound filtering means also provides more degrees of freedom as to the positioning of the sound inlet and the sound output of the second transducer in relation to each other. Omission of any means therebetween will normally require the sound inlet and the sound output to abut each other in order to have sound pass from the second transducer to the first transducer.

The sound filtering means may comprise a sound guiding channel provided between the first and second transducers and being at least partly defined by outer surfaces of the first and/or second transducers.

In this manner, the sound filtering means may simply be provided as an element having therein an open channel, which is closed upon contact with the outer surface(s) of the first and/or second transducer(s).

Optionally or additionally, in this embodiment, the sound filtering means may be at least partly defined by a separate means provided between the first and second transducers.

In an interesting embodiment, the sound filtering means primarily extends in a plane at least substantially parallel to an outer surface of the first and/or the second transducer. This provides a filtering means of any desired shape and length which nevertheless requires little space.

An interesting aspect of this embodiment is one wherein the filtering means is actually provided in a wall part of the housing of one of the first and second transducers. In this manner, the filtering means actually are provided as a channel provided inside the wall, and the opening toward the surroundings then is an opening into the filtering means.

In another embodiment, one of the first and second transducers comprises means for receiving an electrical signal, a filtering circuit positioned within the one transducer and being adapted to receive the electrical signal and provide two electrical signals, and means for outputting one of the provided electrical signals from the one transducer to the other of the first and second transducer.

Thus, the filtering circuit is provided inside one of the transducers, whereby the other transducer may have a standard input with, for example, only two conductors, at least one of which may be connected to the output of the one transducer.

Especially if the one transducer is the first transducer, having the sound inlet, the second transducer may be an off-the-shelf transducer. However, the sound output of the second transducer may be chosen in alternative positions now determined by the acoustical connection desired between the first and second transducers.

In this embodiment, the receiving means of the one transducer comprises at least two electrical terminals or connections between the inner space of the one transducer and the surroundings, and the outputting means comprises at least one further electrical terminal or connection between the inner space of the one transducer and the surroundings.

A third aspect of the invention relates to a method of operating the above module, the method comprising providing an electrical signal to the second transducer, the second transducer outputting a sound through the sound output thereof into the sound input and first or second chamber of the first transducer, and subsequently to the surroundings via the sound output port of the first transducer.

Thus, in general, the transducers of the module may have the same size or different size or shape (e.g. cylindrical, D-shaped, rectangular). In certain applications it could be better to have the sound coming out of the 'tweeter' (preferred to get the best high frequency response). In others it could be preferred to have the sound coming out of the "woofer". This depends on, for instance, the interaction between the two receivers in the frequency domain and the time domain. Sometimes phase shifts between the receivers cannot be corrected electronically, but might be corrected by the position of the holes in the cover and where the sound leaves the module.

BRIEF DESCRIPTION OF THE DRAWINGS

The foregoing and other advantages of the invention will become apparent upon reading the following detailed description and upon reference to the drawings.

Figure 1:
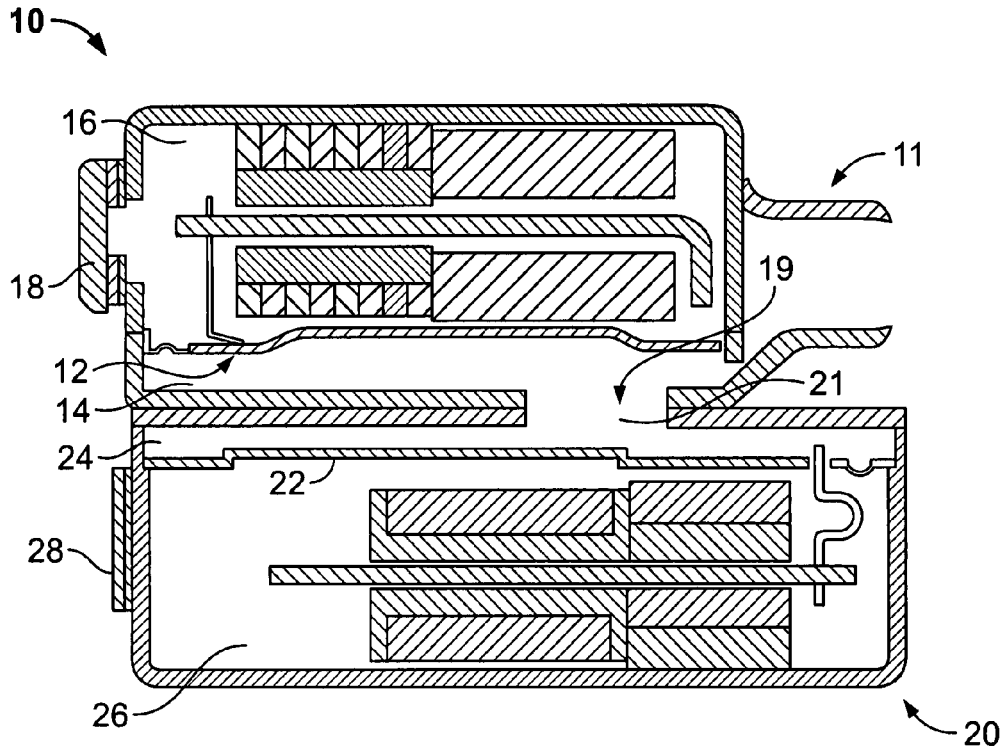
FIG. 1 illustrates a cross section of a system comprising two transducers and a single sound output to the surroundings.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, alternatives, combinations and/or subcombinations of the disclosed concepts falling within the spirit and scope of the disclosed invention as defined, herein and as set forth in the appended claims.

DETAILED DESCRIPTION OF THE INVENTION

In FIG. 1, an embodiment is seen wherein two transducers, 10, 20, are provided. The first transducer 10 has a movable diaphragm 12 adapted to be moved so as to generate sound. Suitable motor or movement generating means used therefore are well known. Such motor means are positioned within the housing of transducer 10 and are fed an electrical signal via solder bumps 18 outside the housing.

The diaphragm 12 separates an inner space of the transducer 10 into a first chamber 14 and a second chamber 16. These chambers normally are called the upper chamber and the lower chamber of the transducer 10.

One of the chambers 14, 16 is connected to a sound output 11 adapted to guide sound from inside the transducer 10 to the surroundings. This sound output 11 preferably has a spout connected thereto in order to facilitate acoustical connection thereto.

So far, the transducer 10 may be a standard receiver as is well known in the field of hearing aids, headsets, personal communication devices, in-ear monitors, hearing protection devices, cell phones, PDA's and the like, where highly efficient and extremely compact sound emitters are required.

The second transducer 20 also has a number of standard elements: a movable diaphragm 22 dividing the inner space of the transducer 20 into a third chamber 24 and a fourth chamber 26, solder bumps 28 for use in feeding an internal motor/movement means engaging the diaphragm 22, as well as a sound output 21.

However, the first transducer 10 also comprises a sound inlet 19, and the transducer 20 is positioned so as to output sound from the output 21 into the inlet 19. Thus, the sound from transducer 20 is output to the surroundings via one of the chambers 14/16 and the sound output 11 of the transducer 10.

In this manner, only a single output 11 is provided from the two transducers.

Naturally, the inlet 19 and the output 11 may be from the same or different chambers (14 and 16).

It may be desired to provide a resilient damping material between the transducers 10, 20 in order to avoid rub and buzz noise from these when vibrating.

In addition, the transducers 10, 20 may be identical or different. The difference may be in size/shape, frequency output (e.g., tweeter/midrange/woofer), intensity output, driver type (e.g., Moving Coil, Balanced Armature, Piezo), or the like.

As will become clear further below, this manner of outputting the sound from transducer 20 via the transducer 10 provides a large number of filtering possibilities, whereby the sound from the two transducers 10, 20 may be filtered in a number of manners. The sound from the transducer 10 is affected both by the inlet 19 and the transducer 20 (chambers 24/26, diaphragm 22) as well as the output 11.

Different characteristics will be seen depending of whether the inlet 19 is in the same or the other chamber (14, 16) as the output 11.

Also, the positions of the output 21 and inlet 19 in the respective transducers 10, 20 will have an effect on the sound output from the output 11.

The sound from the transducer 20 naturally is affected by the output 21, inlet 19 as well as the internal components of the first transducer 10.

Figure 2:
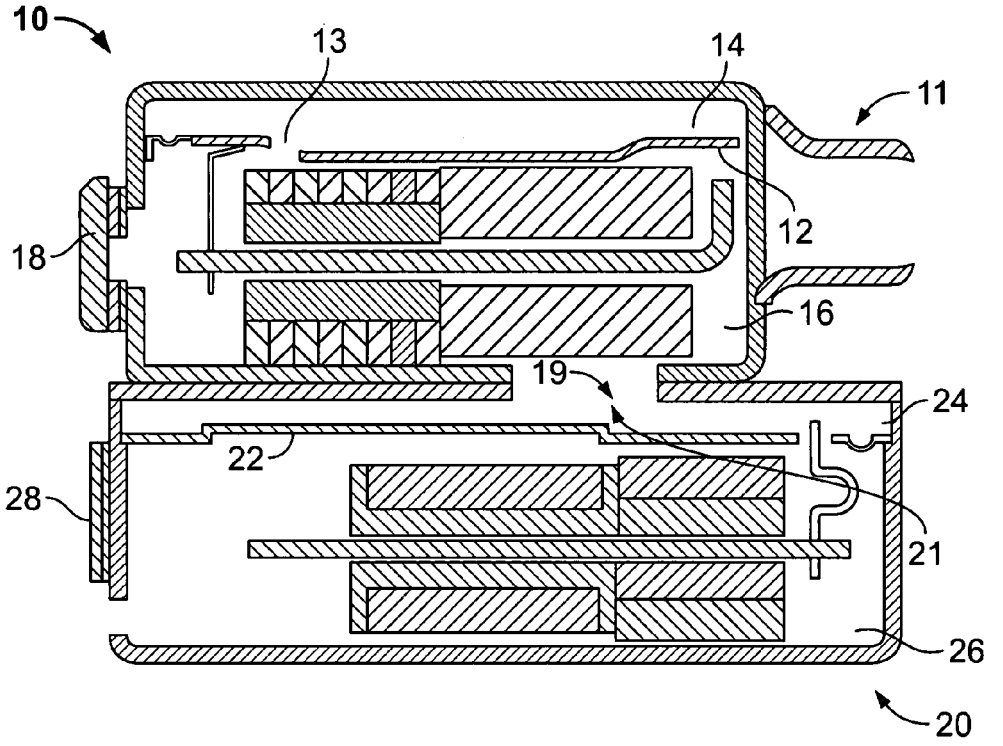
FIG. 2 illustrates a cross section of a system where sound from one transducer is guided past the diaphragm of the other transducer.

In addition, further elements may be provided for altering the sound from the transducers 10 and 20. This may be seen in FIG. 2, wherein the output 11 connects the chamber 14 to the surroundings, and where the inlet 19 is in the chamber 16, so that sound from the transducer 20 must pass also the diaphragm 12 in order to be output through the output 11.

In this embodiment, a hole or opening 13 is provided in the diaphragm 12. The opening 13 may alternatively be provided in a support or suspension of the diaphragm. This opening 13 has a diameter of about 50-300 μm, whereby this opening is acoustically transparent for sound having a frequency lower than about 300 Hz. Other filtering characteristics may be obtained using openings of other dimensions. Any number of openings may be provided.

Consequently, the diaphragm 12 will function excellently even though lower frequencies pass through it.

Then, the transducer 20 may be used as a woofer outputting primarily sound with a frequency of 300 Hz or lower (such as 500-80 Hz), and the transducer 10 may be used as a tweeter providing sound of higher frequencies. It is noted that the second transducer 20 may output sound with any frequencies desired. Higher frequencies are simply filtered and will experience a loss when passing the diaphragm 12.

The opening 13 is not required in the diaphragm 12, which will also convey sound there across when no opening 13 is provided. The opening 13 merely provides a simple manner of filtering sound from the second transducer 20.

Naturally, the electrical signals provided to the transducers 10, 20 may be filtered in order to determine the frequency output characteristics of the transducers. However, also other characteristics of the transducers may be adapted to output the desired sound characteristics, such as to function as tweeter or woofer. Thus, tweeters normally would have a lower moving mass than a woofer. This moving mass will aid in defining the resonance frequency of the transducer. This mass will in itself have an effect on the frequency response of the transducer.

Another manner of affecting the sound output from the output 11 is to provide an acoustical filtering element between the transducers 10 and 20, that is, between the inlet 19 and the output 21.

Figure 3:
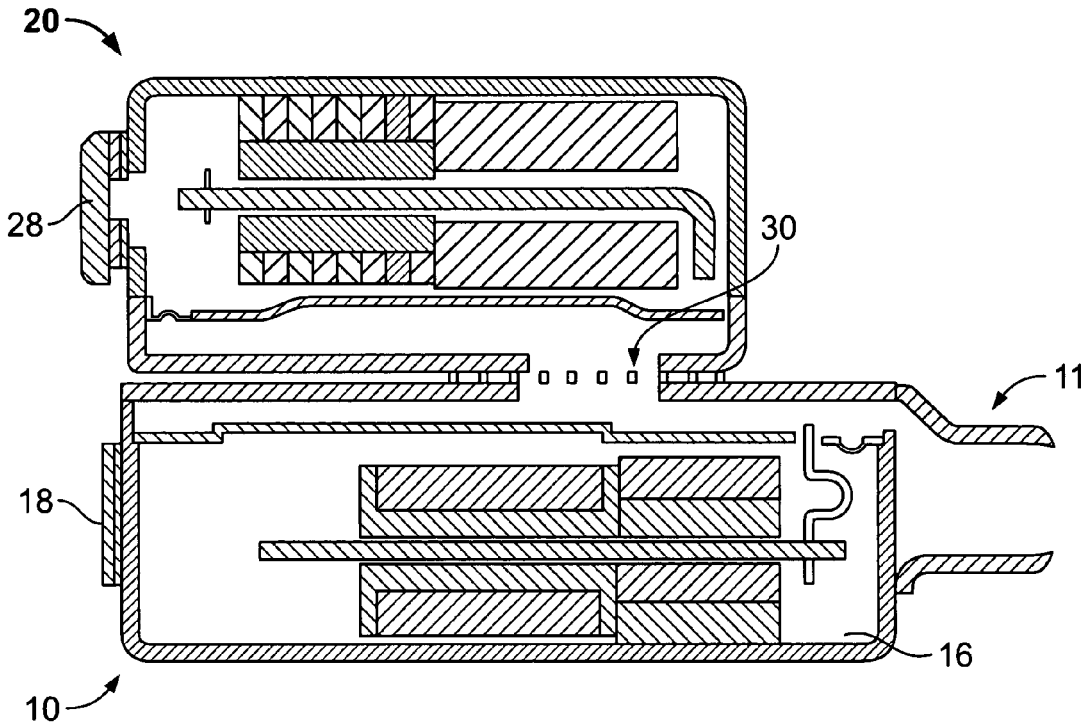
FIG. 3 illustrates a cross section of a system having a damping element between the two transducers.

This filtering element may be provided, as is seen in FIG. 3, as a flat element 30 positioned in the sound path between the two transducers 10 and 20. This element may just as well be positioned in the input 19 or the output 21.

This element 30 may be a simple grating or an element having a well-defined opening or hole therein. In this manner, the openings provided in the inlet 19 and the output 21 need not be that well-defined.

Due to the positioning of the element 30 between two outer surfaces, which are normally at least substantially flat, this element may be rather large, more easily positioned, and may serve also other purposes, such as cushioning between the two transducers 10, 20 so as to avoid mechanical noise. Alternatively, the fastening of the element 30 to the transducers 10, 20 may also result in the fastening of the transducers 10, 20 to each other.

It is clear that the element 30 may be provided in a number of manners and with a wide variety of functions.

Figure 4:
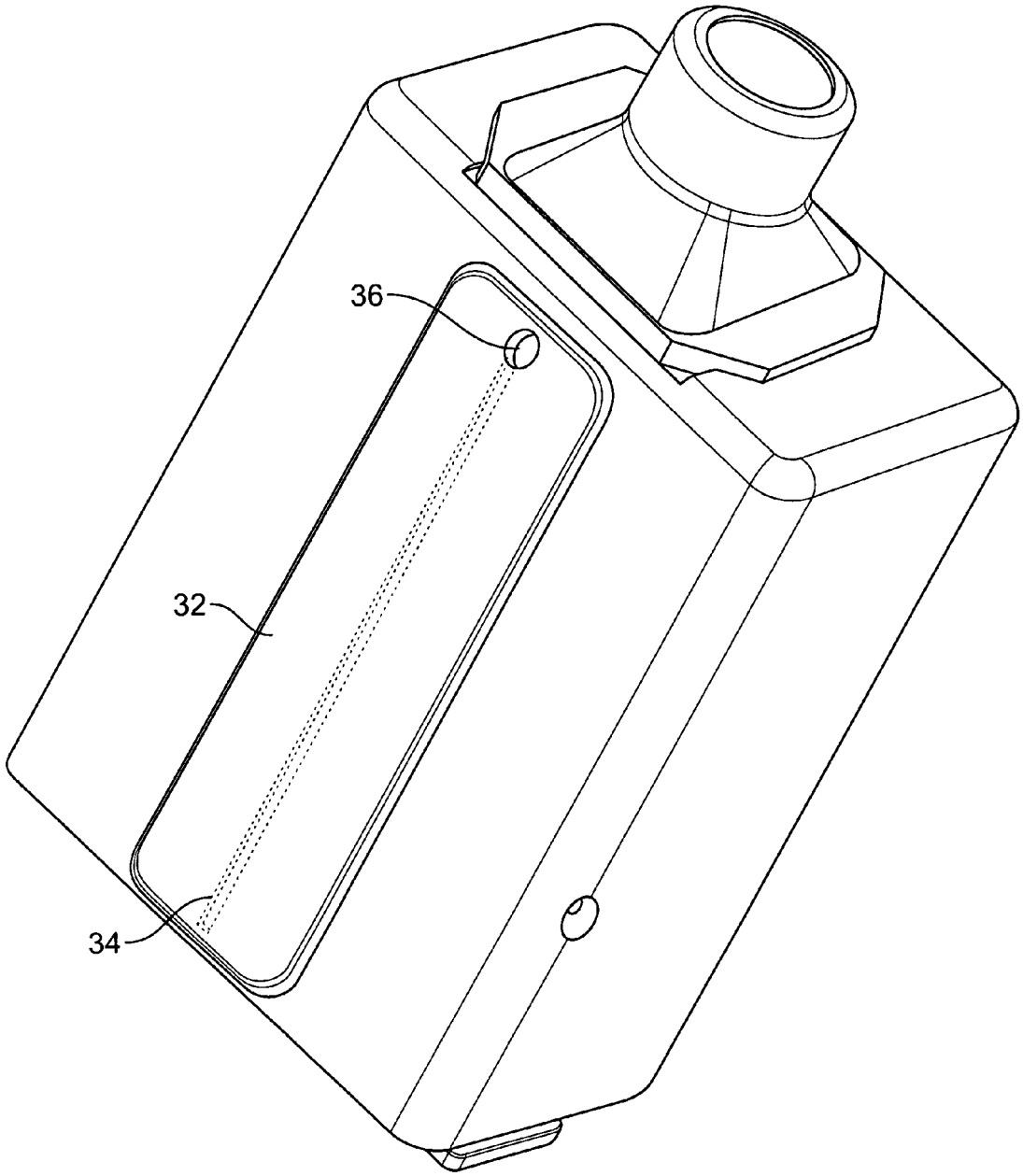
FIG. 4 illustrates the use of a separate element for guiding sound from one transducer to the other transducer.

FIG. 4 illustrates another embodiment where, however, only the transducer 20 has been removed to enhance the understanding of the figure. In FIG. 4, an element 32 is positioned between the two transducers and defines, internally therein, an oblong channel 34 extending in a plane of the element 32 and of the outer surfaces of the transducers 10 and 20. Also, the element 32 has an opening or openings 36 (one on either side, normally) toward the inlet 19 and the output 21 in order to function as a guide/filter of the sound travelling between the transducers 10 and 20. As shown in FIG. 4, for example, a substantially circular opening 36 is provided at the upper portion of the oblong channel 34.

Naturally, the shape, size, dimensions of the channel 34 of the element 32 will affect the sound travelling there through. In addition, the element 32 may be used for more freely defining the positions of the inlet 19, output 21 and generally the transducers 10, 20 in relation to each other.

Figure 5:
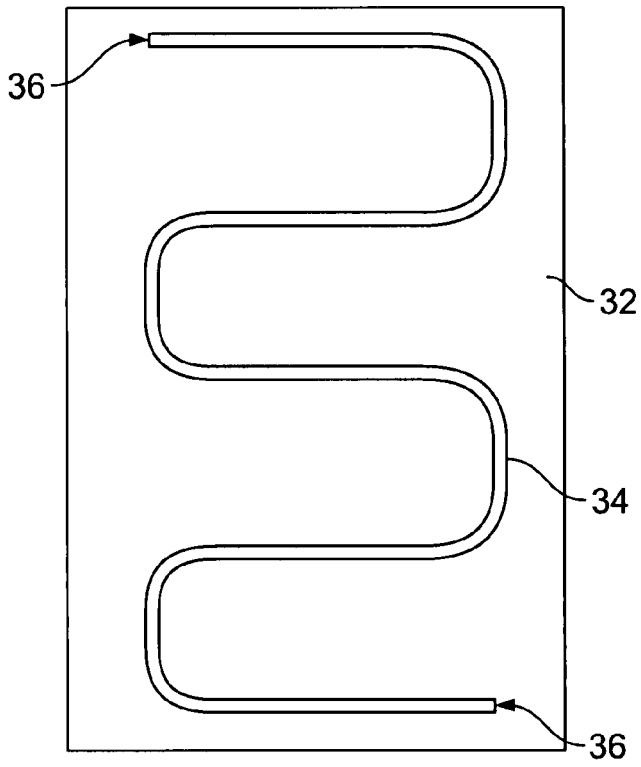
FIG. 5 illustrates an alternative shape of a sound guiding element.

Another example of a shape of the channel 34 of the element 32 may be seen in FIG. 5, where the channel 34 is of a generally serpentine configuration.

In addition, the channel 34 need not be a simple, oblong channel with the same cross-section along its length. The internal shape of this channel may be shaped in any desired manner in order to provide the desired filtering.

In FIGS. 4 and 5, the element 32 is illustrated as having the channel 34 defined fully inside the element 32 with openings 36 from the channel 34 to the surface of the element 32 for sound to enter and exit. An alternative embodiment would be one wherein the outer surfaces of the transducers 10, 20 take part in the definition of the shape of the channel 34, and where the element 32 only defines the walls/surfaces of the channel 34 in the plane of the surfaces of the transducers. In this situation, the openings 36 are not required in that the inlet 19 and output 21 will then open directly into the channel 34.

Alternatively, the channel 34 could be provided fully inside the wall part of one of the transducers 10, 20 and thereby be seen either as a filtering element or just as a part of the inlet 19 or output 21. Naturally, the same shapes, etcetera, may be used in that situation.

When generating the sound from multiple transducers, it is often desired to be able to feed the assembly a single signal corresponding to the sound desired but to electrically filter this signal and feed different signals to each of the transducers (such as to a tweeter and a woofer). This filtering may be performed using a crossover circuit filtering the signal input and feeding different signals to the two transducers.

Figure 6:
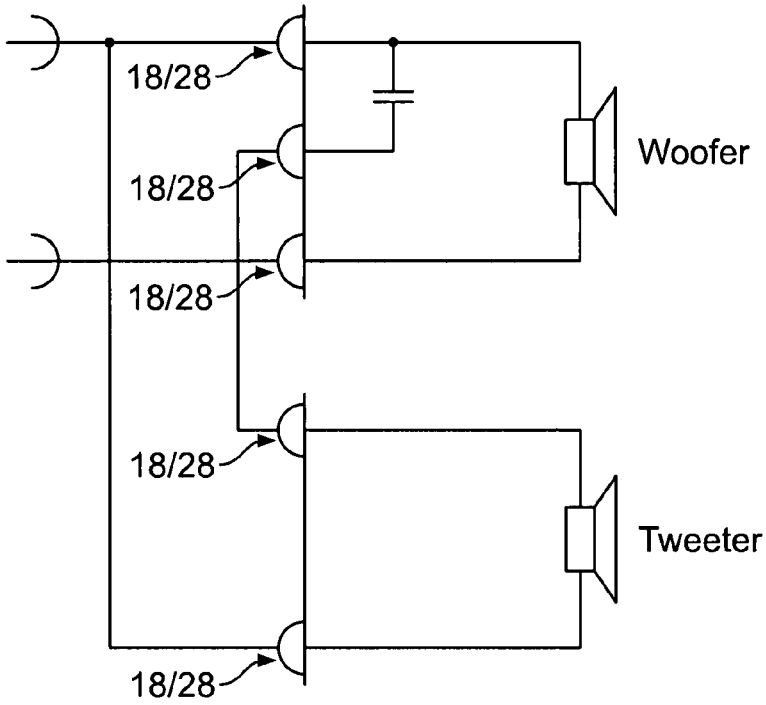
FIG. 6 illustrates a crossover network for use in the present system.

A circuit of this type may be seen in FIG. 6, which also illustrates the solder bumps 18/28 of the transducers. The positioning of the circuit and the solder bumps illustrates that the circuit actually is positioned within the housing of one of the transducers 10/20, which thus has not only the two solder bumps for entry of the signal into the housing but a third solder bump (the second solder bump from the top) for use in outputting the signal from the crossover circuit to the other transducer. It is seen that the signal from the second solder bump from the top is fed to the lower transducer.

In the present example, the electrical filter circuit is a single 100 nF capacitor adapted to remove lower frequencies. This capacitor may have one or more outer dimensions as small as 0.33 mm and may be used for feeding a tweeter.

Thus, in the present situation, one of the transducers 10, 20 may receive the signal from, for example, an amplifier and provide two different signals, one of which is fed to the means moving the diaphragm of this transducer and one which is output from this transducer and fed to the other transducer.

Thus, the present system may be provided as an assembled unit where the transducers 10 and 20 are pre-connected, and where only a connection between two solder bumps 18/28 are required to, for example, an amplifier in order to have an operational sound provider.

Naturally, even though the embodiments described above comprise only two transducers, any number of transducers may be used. More transducers may be desired in order to provide a higher sound intensity or in order to provide a better quality of the sound, such as to combine special purpose transducers each especially suited to generate a particular sound or sound frequency interval. Thus, the use of both a tweeter, a woofer, and a mid-range transducer would be possible.

Thus, a single output toward the surroundings may still be obtained, but these different transducers may be combined in any desired manner. One transducer output sound to the surroundings through two or more other transducers, or multiple transducers may be adapted to emit sound at different positions into the transducer with the output toward the surroundings. Different sizes, dimensions, shapes, filtering elements etc. may be used in order to obtain the desired sound.

Also, more extra solder bumps may be provided on a transducer holding therein a crossover circuit, if this circuit is to feed more than one external transducer.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the claimed invention, which is set forth in the following claims.

What is claimed is:

1. A speaker module for use in a personal communication device, the module comprising:

a first transducer adapted to receive a first electrical signal and output a corresponding sound, the first transducer comprising a first housing, a movable diaphragm positioned inside the first housing and which divides an inner space of the first housing into a first chamber and a second chamber, a sound output port connecting one or both of the first chamber and the second chamber to the surroundings, and a sound input connected to the first or the second chamber; and a second transducer adapted to receive a second electrical signal and output a corresponding sound, the second transducer comprising a second housing, a movable diaphragm positioned within the second housing and which divides an inner space of the second housing into a third chamber and a fourth chamber, and a sound output connected to one or both of the third chamber and the fourth chamber, the second sound output being acoustically connected to the sound input of the first transducer.

2. A module according to claim 1, wherein the sound output port of the first transducer is connected to the first chamber, and where the sound input of the first transducer is connected to the second chamber.

3. A module according to claim 2, wherein the diaphragm of the first transducer has therein a hole or opening having a predetermined shape.

4. A module according to claim 3, wherein:

the first transducer has a first acoustic resonance frequency, and the second transducer has a second acoustic resonance frequency, the second resonance frequency being lower than the first resonance frequency, where the opening or hole in the diaphragm of the first transducer is adapted to transmit the second resonance frequency.

5. A module according to claim 1, the module comprising a sound filtering means adapted to guide sound from the sound output of the second transducer to the sound input of the first transducer, the sound filtering means being dimensioned to filter the guided sound.

6. A module according to claim 5, wherein the sound filtering means comprises a sound guiding channel provided between the first and second transducers and being at least partly defined by outer surfaces of the first and second transducers.

7. A module according to claim 5, wherein the sound filtering means is at least partly defined by a separate means provided between the first and second transducers.

8. A module according to claim 5, wherein the sound filtering means primarily extends in a plane at least substantially parallel to an outer surface of the first and/or the second transducer.

9. A module according to claim 1, wherein one of the first and second transducers comprises:

means for receiving an electrical signal, a filtering circuit positioned within the one transducer and being adapted to receive the electrical signal and provide two electrical signals, and means for outputting one of the provided electrical signals from the one transducer to the other of the first and second transducer.

10. A module according to claim 9, wherein the receiving means comprises at least two electrical connections between the inner space of the one transducer and the surroundings, and wherein the outputting means comprises at least one further electrical connection between the inner space of the one transducer and the surroundings.

11. A method of operating the module of claim 1, the method comprising providing an electrical signal to the second transducer, the second transducer outputting a sound through the sound output thereof into the sound input and first or second chamber of the first transducer, and subsequently to the surroundings via the sound output port of the first transducer.

12. A module according to claim 1, wherein the sound output port of the first transducer is positioned at a first location and the sound input of the first transducer is positioned at a second location different from the first location such that the sound output via the second transducer propagates from the second housing to the surroundings via at least one of the first and second chambers of the first transducer.

13. A module according to claim 12, wherein, when both the first and second transducers are active, sound output of the module is the sum of the output of the first transducer and the sound output of the second transducer as affected by transport thereof through the first transducer.

14. A speaker module for use in a personal communication device, the speaker module comprising:

a first transducer adapted to receive a first electrical signal and output a corresponding sound, the first transducer comprising a first housing, a movable diaphragm positioned inside the first housing and which divides an inner space of the first housing into a first chamber and a second chamber, a sound output port connecting one or both of the first chamber and the second chamber to the surroundings, and a sound input connected to the first or the second chamber; and a second transducer adapted to receive a second electrical signal and output a corresponding sound, the second transducer comprising a second housing, a movable diaphragm positioned within the second housing and which divides an inner space of the second housing into a third chamber and a fourth chamber, and a sound output connected to one or both of the third chamber and the fourth chamber, the second sound output being acoustically connected to the sound input of the first transducer, wherein the sound output port of the first transducer is connected to the first chamber, and the sound input of the first transducer is connected to the second chamber.

15. A speaker module according to claim 14, wherein the diaphragm of the first transducer has therein a hole or opening having a predetermined shape.

16. A speaker module according to claim 15, wherein the first transducer has a first acoustic resonance frequency, and the second transducer has a second acoustic resonance frequency, the second resonance frequency being lower than the first resonance frequency, and wherein the hole or opening in the diaphragm of the first transducer is adapted to transmit the second resonance frequency.

17. A speaker module for use in a personal communication device, the speaker module comprising:

a first transducer adapted to receive a first electrical signal and output a corresponding sound, the first transducer comprising a first housing, a movable diaphragm positioned inside the first housing and which divides an inner space of the first housing into a first chamber and a second chamber, a sound output port connecting one or both of the first chamber and the second chamber to the surroundings, and a sound input connected to the first or the second chamber;

a second transducer adapted to receive a second electrical signal and output a corresponding sound, the second transducer comprising a second housing, a movable diaphragm positioned within the second housing and which divides an inner space of the second housing into a third chamber and a fourth chamber, and a sound output connected to one or both of the third chamber and the fourth chamber, the second sound output being acoustically connected to the sound input of the first transducer; and a sound filtering means adapted to guide sound from the sound output of the second transducer to the sound input of the first transducer, the sound filtering means being dimensioned to filter the guided sound.

18. A speaker module according to claim 17, wherein the sound filtering means comprises a sound guiding channel provided between the first and second transducers and being at least partly defined by outer surfaces of the first and second transducers.

19. A speaker module according to claim 17, wherein the sound filtering means is at least partly defined by a separate means provided between the first and second transducers.

20. A speaker module according to claim 17, wherein the sound filtering means primarily extends in a plane at least substantially parallel to an outer surface of the first and/or the second transducer.

* * * * *